US009464529B2

(12) United States Patent
Zambetti et al.

(10) Patent No.: US 9,464,529 B2
(45) Date of Patent: Oct. 11, 2016

(54) BLADE FOR A GAS TURBINE

(75) Inventors: Chiara Zambetti, Baden (CH); Sergei Riazantsev, Nussbaumen (CH); Hélène Saxer-Felici, Mellingen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 759 days.

(21) Appl. No.: 13/245,707

(22) Filed: Sep. 26, 2011

(65) Prior Publication Data

US 2012/0070309 A1 Mar. 22, 2012

Related U.S. Application Data

(63) Continuation of application No. PCT/EP2010/052867, filed on Mar. 5, 2010.

(30) Foreign Application Priority Data

Mar. 30, 2009 (CH) ..... 0502/09

(51) Int. Cl.
*F01D 5/22* (2006.01)

(52) U.S. Cl.
CPC ..... *F01D 5/225* (2013.01); *F05D 2240/81* (2013.01); *F05D 2260/202* (2013.01)

(58) Field of Classification Search
CPC ..... F01D 5/225; F05D 2240/81; F05D 2260/202
USPC ..... 415/115, 116; 416/93 R, 95, 96 R, 97 R, 416/97 A
See application file for complete search history.

(56) References Cited

U.S. PATENT DOCUMENTS

| | | | | |
|---|---|---|---|---|
| 5,460,486 | A * | 10/1995 | Evans et al. | 416/97 R |
| 5,482,435 | A * | 1/1996 | Dorris et al. | 416/97 R |
| 5,779,447 | A * | 7/1998 | Tomita et al. | 416/97 R |
| 5,785,496 | A * | 7/1998 | Tomita | 416/97 R |
| 6,099,253 | A * | 8/2000 | Fukue et al. | 416/97 R |
| 6,152,695 | A * | 11/2000 | Fukue et al. | 416/97 R |
| 6,340,284 | B1 * | 1/2002 | Beeck et al. | 415/115 |
| 6,464,460 | B2 * | 10/2002 | El-Nashar et al. | 416/92 |
| 6,761,534 | B1 * | 7/2004 | Willett | 416/97 R |
| 7,334,993 | B2 * | 2/2008 | Sekihara et al. | 416/97 R |
| 7,568,882 | B2 * | 8/2009 | Brittingham et al. | 415/1 |
| 7,762,774 | B2 * | 7/2010 | Liang | 416/97 R |
| 2001/0006600 | A1 * | 7/2001 | El-Nashar et al. | 416/92 |
| 2006/0182622 | A1 * | 8/2006 | Parker et al. | 415/116 |

FOREIGN PATENT DOCUMENTS

| | | | |
|---|---|---|---|
| DE | 19601818 | A1 | 8/1996 |
| EP | 1013884 | A2 | 6/2000 |
| EP | 1591625 | A1 | 11/2005 |
| GB | 2298246 | A | 8/1996 |

* cited by examiner

*Primary Examiner* — Dwayne J White
*Assistant Examiner* — Aaron R Eastman
(74) *Attorney, Agent, or Firm* — Buchanan Ingersoll & Rooney PC

(57) ABSTRACT

A blade, for a gas turbine, includes a blade airfoil, having a shroud segment arranged on its upper end. The shroud segment together with shroud segments of other blades of a blade row forming an annular shroud which delimits hot gas passage of the gas turbine, and said shroud segment, on sides on which it adjoins adjacent shroud segments of the annular shroud, is provided with upwardly projecting side rails which extend along a side edge, to improve sealing to the hot gas passage. The side rails include rail-parallel or essentially rail-parallel, upwardly open slots through which cooling air, which is introduced via the shroud segment from an interior of the blade airfoil, discharges into the space above the shroud segment.

17 Claims, 5 Drawing Sheets

BLADE FOR A GAS TURBINE

CROSS REFERENCE TO RELATED APPLICATION

This application is a continuation of International Application No. PCT/EP2010/052867 filed Mar. 5, 2010, which claims priority to Swiss Patent Application No. 00502/09, filed Mar. 30, 2009, the entire contents of all of which are incorporated by reference as if fully set forth.

FIELD OF INVENTION

The present invention relates to the field of gas turbine technology. Specifically, it refers to a blade for a gas turbine.

BACKGROUND

A gas turbine blade, which on the blade tip is equipped with a shroud segment, is known from EP-A1-1591 625. The shroud segments of the blades of a blade row together form an encompassing shroud. On the side edges, by which the adjacent shroud segments of a shroud abut, the shroud segments are provided with upwardly projecting side rails which extend along the side edges and improve the leak-proofness of the shroud in relation to the hot gas passage of the turbine. No statement is made about the cooling of the shroud segments or of the shroud.

A turbine blade arrangement, with a shroud in which the shroud segments are equipped with an encompassing sealing rib in which provision is made for a similarly encompassing slot, is known from DE-A1-196 01 818. An air flow which is fed there in the bottom region of the slot discharges on the upper edge of the sealing rib and in the gap between upper edge and adjoining passage wall intermixes with a leakage air flow. The air flow which is fed into the slot in this case can be obtained from a cooling air flow which is directed through the shroud segment. The main point for consideration in this case is still the reduction of leakage losses but not the cooling of the shroud segment.

SUMMARY

The present disclosure is directed to a blade, for a gas turbine, including a blade airfoil, having a shroud segment arranged on its upper end. The shroud segment together with shroud segments of other blades of a blade row forming an annular shroud which delimits hot gas passage of the gas turbine, and said shroud segment, on sides on which it adjoins adjacent shroud segments of the annular shroud, is provided with upwardly projecting side rails which extend along a side edge, to improve sealing to the hot gas passage. The side rails include rail-parallel or essentially rail-parallel, upwardly open slots through which cooling air, which is introduced via the shroud segment from an interior of the blade airfoil, discharges into the space above the shroud segment.

BRIEF DESCRIPTION OF THE DRAWINGS

The invention is subsequently explained in more detail based on exemplary embodiments in conjunction with the drawing. All elements which are not necessary for the direct understanding of the invention have been omitted. Like elements are provided with the same designations in the different figures. In the drawings.

Figure 1:
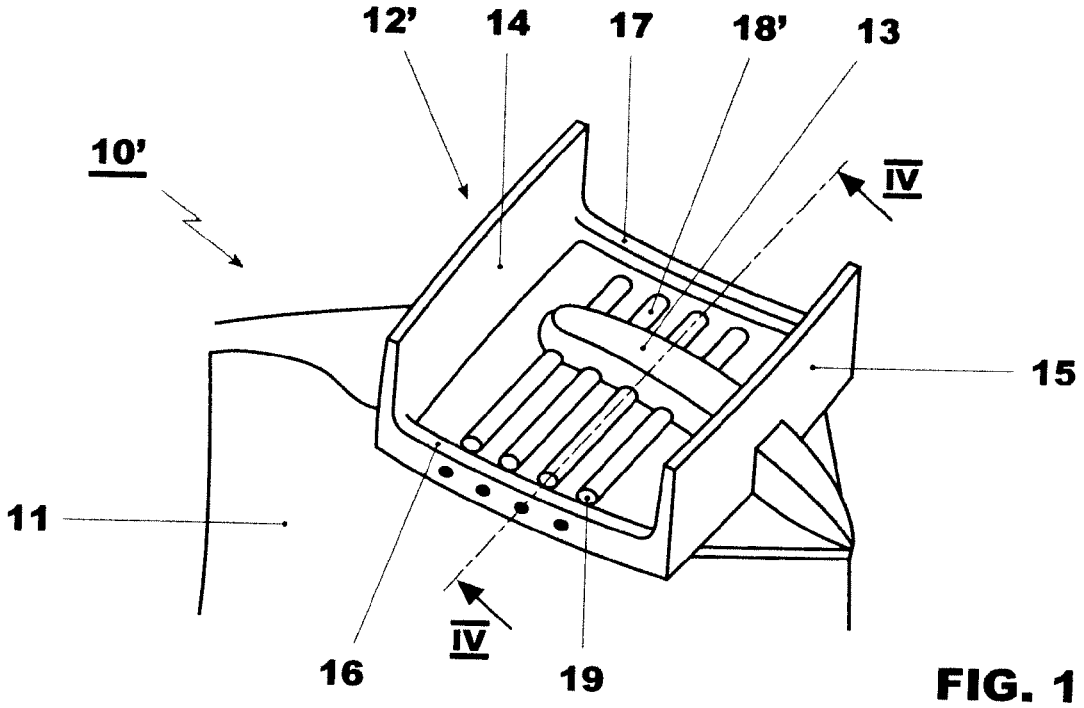
FIG. 1 shows a simplified perspective view of a blade tip—provided with a shroud segment with cooling holes—of a gas turbine blade.

DETAILED DESCRIPTION OF THE PREFERRED EMBODIMENTS INTRODUCTION TO THE EMBODIMENTS

The invention should provide a remedy to the above-noted drawbacks. It is therefore an object of the invention to create a gas turbine blade with cooled shroud segment, in which cooling of the side rails is maximized.

The object is achieved by means of the features of the appended claims. It is preferable for the invention that for improving the cooling in the region of the side rails an arrangement is made in the side rails for rail-parallel, upwardly open slots through which cooling air, which is introduced via the shroud segment from the interior of the blade airfoil, discharges into the space above the shroud segment.

This is preferably achieved, according to one embodiment of the invention, by a multiplicity of cooling tubes, extending transversely to the side rails, being arranged on the upper side of the shroud segment, which cooling tubes extend from a center piece arranged between the side rails and from there are impinged upon with cooling air, and which terminate in the side rails and are in communication with the slots in said side rails.

In another embodiment of the invention, the center piece is arranged in the middle between the side rails. The center piece can also be arranged offset to the middle between the side rails.

The cooling tubes especially extend parallel to each other, wherein the center piece extends essentially parallel to the side rails.

In this case, the cooling tubes can extend in the circumferential direction of the shroud. It is also conceivable, however, that the cooling tubes extend obliquely to the circumferential direction of the shroud.

In another embodiment of the invention, the cooling tubes have a cooling hole in each case and are designed for convective cooling of the shroud segment, and the cooling tubes are formed on the shroud segment.

In a further embodiment of the invention, the cooling tubes of blades which adjoin each other by the shroud segments are arranged in a staggered manner.

According to another embodiment of the invention, the shroud segment is delimited in the axial direction by wall segments which extend in the circumferential direction, wherein the cooling air which discharges from the slots is fed via cooling holes in the region of the wall segments and of the side rails.

In a further embodiment, the shroud segment is delimited in the axial direction by wall segments which extend in the circumferential direction. Parallel to the wall segments, provision is made for an intermediate wall segment which is arranged in the middle between the wall segments, and between the intermediate wall segment and the wall segments provision is made for a slot in the side rails in each case.

The slots of a side rail in this case can especially be interconnected in each case by means of a cooling hole which extends in the side rail.

According to another embodiment, film cooling holes project from the cooling holes which supply the slots and on the underside of the shroud segment open into the hot gas passage.

DETAILED DESCRIPTION

In FIGS. 1, 2, 4 and 5, the blade tip—provided with a shroud segment—of a gas turbine blade is shown in perspective view or in cross section. The blade 10', of which only the upper section of the blade airfoil 11 with the shroud segment 12' is shown, has a cooled shroud segment 12'

The shroud segment 12', which in the depicted example is approximately rectangular in the base surface, is delimited on two opposite sides by comparatively high wall segments 14 and 15 which together with the wall segments of the other blades of a complete blade row form annularly encompassing walls, between which is formed a shroud cavity which is sealed against penetration of hot gas from the hot gas passage which lies beneath it. To this end, edge-parallel, upwardly projecting side rails 16, 17, by which adjacent shroud segments of the blade row abut, are formed on the two other sides of the shroud segment 12'.

Figure 2:
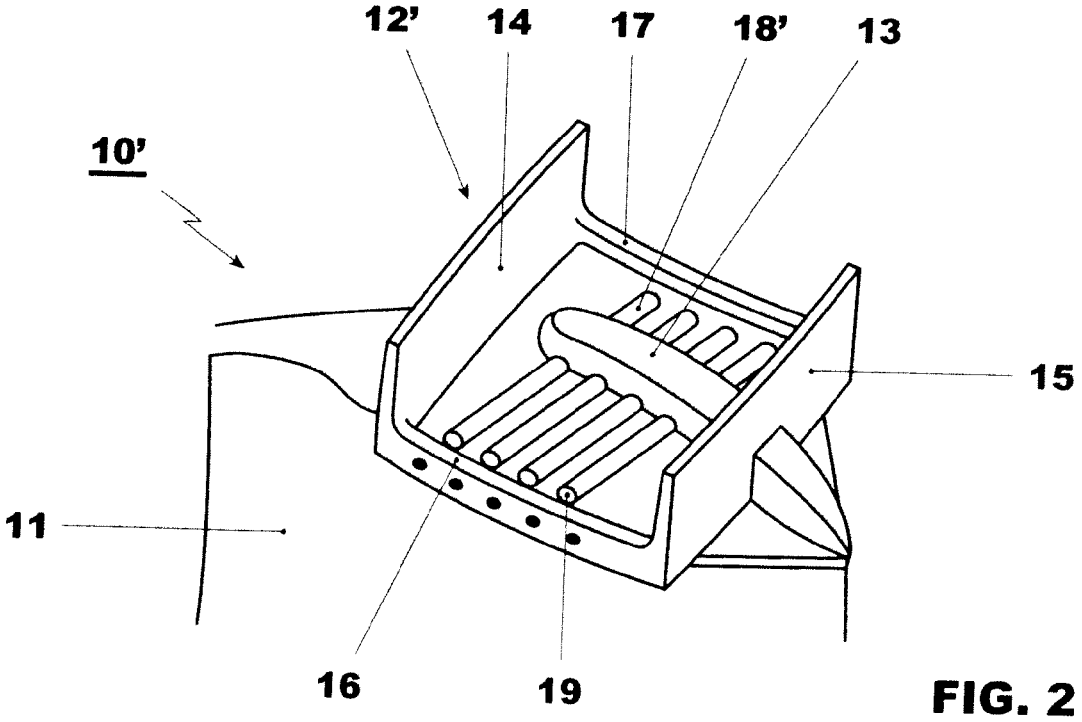
FIG. 2 shows a blade comparable to FIG. 1 with obliquely extending cooling holes.

For cooling of the shroud segment 12 which is impinged upon by the hot gas, provision is made for special measures:

Arranged in the middle between the two side rails 16, 17 (FIG. 4), or offset from the middle to the side (FIG. 5), is a rib-like, internally hollow center piece 13, parallel to the side rails, which is in communication with the cooling air passages which extend inside the blade airfoil 11 in the radial direction. From the center piece 13, which extends parallel or virtually parallel to the side rails 16, 17, cooling tubes 18, which are formed on both sides of the center piece on the upper side of the shroud segment 12', extend in the direction of the side rails 16, 17 and transversely thereto, and terminate at a distance before said side rails 16, 17. In the example of FIG. 1, provision is made on both sides of the center piece 13 for four parallel cooling tubes 18 in each case, which extend parallel or virtually parallel to the wall segments 14, 15. However, they can also be oriented obliquely to the wall segments 14, 15 (FIG. 2).

As a result of the distance between the ends 19 of the cooling tubes 18 and the side rails 16, 17, a gap 22 is created. The cooling air, which flows through the cooling holes 21 inside the cooling tubes 18 and so convectively cools the shroud segment 12', discharges into this gap 22. The cooling air which flows through the cooling tubes 18 originates from the cooling air feed 20 inside the center piece 13 with which the cooling holes 21 are in communication, and into which a cooling air flow 25 enters from the bottom.

The cooling air which discharges from the cooling tubes 18 into the gap 22 flows from there into the shroud cavity which lies above it without intensively cooling the side rails 16, 17. In this case, measures are therefore implemented by means of which the side rails, which consist of a solid material, are cooled even better in order to reduce the thermal load of the side rails and to relieve thermal stresses between the side rails and the remaining region of the shroud segments.

Figure 3:
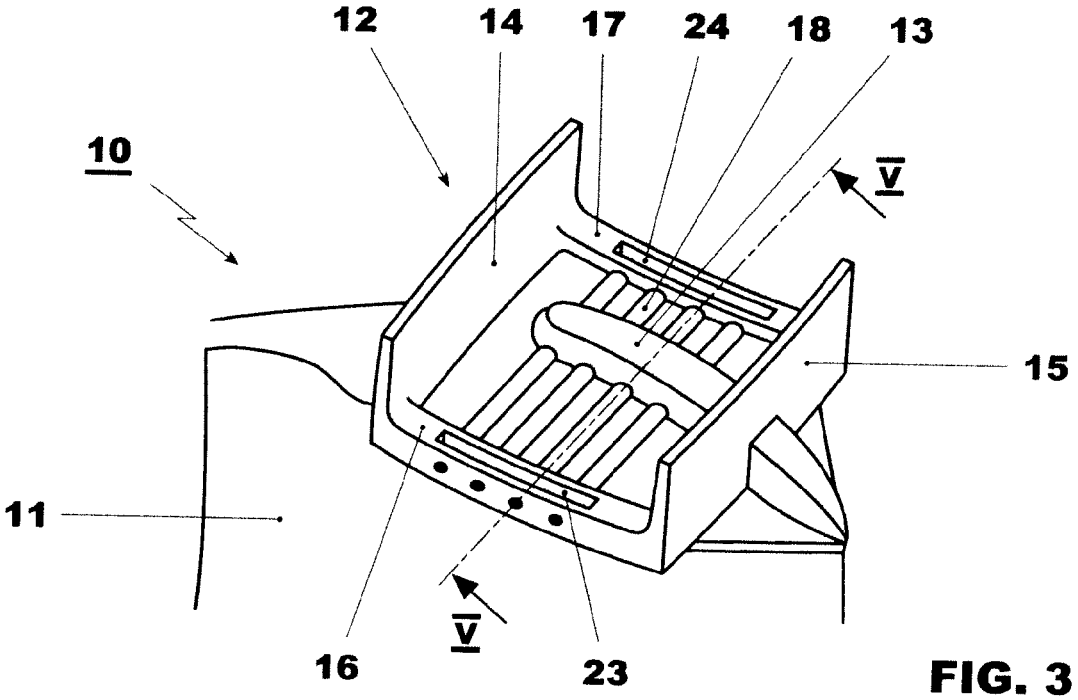
FIG. 3 shows in a view comparable to FIG. 1 the blade tip—provided with a shroud segment with slots—of a gas turbine blade according to a preferred embodiment of the invention.
Figure 4:
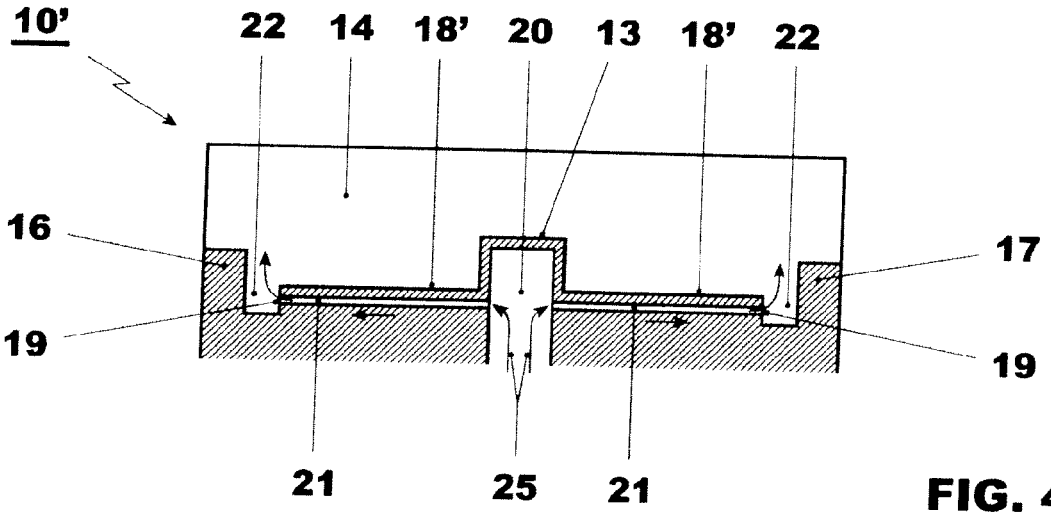
FIG. 4 shows the section through the shroud segment of the blade from FIG. 1 in the plane IV-IV, wherein the center piece, from which the cooling holes extend, lies in the middle.
Figure 5:
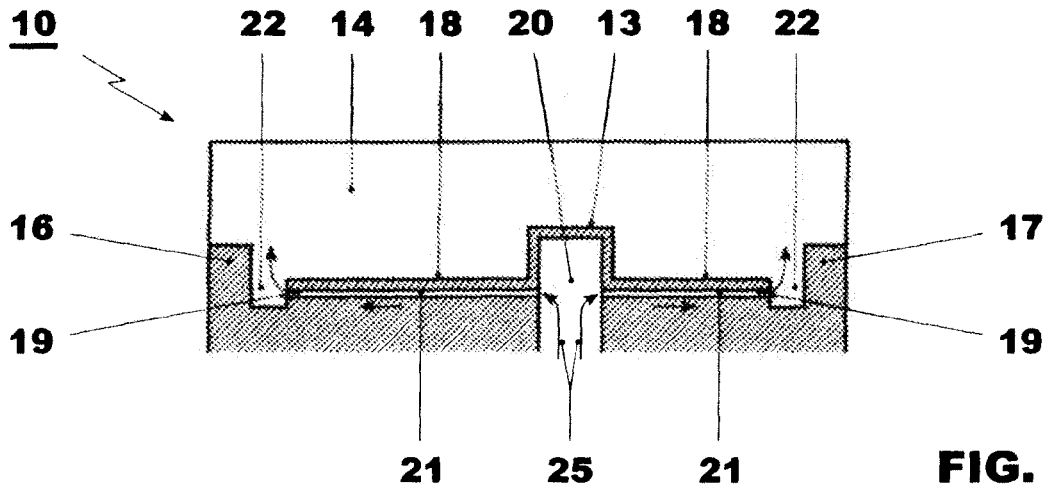
FIG. 5 shows the section through the shroud segment of the blade from FIG. 1 in the plane IV-IV, wherein the center piece, from which the cooling holes extend, is offset from the middle.
Figure 6:
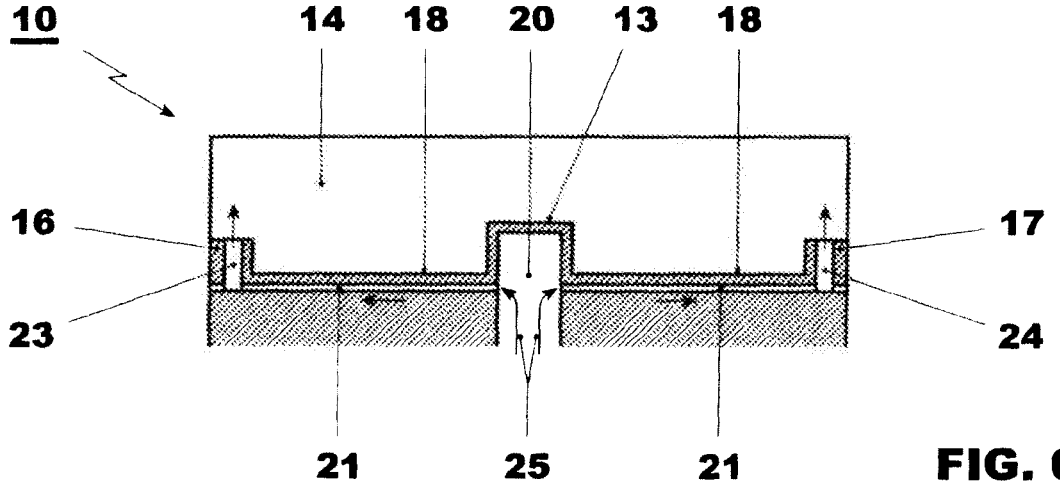
FIG. 6 shows the section through the shroud segment of the blade from FIG. 3 in the plane V-V, wherein the center piece, from which the cooling holes extend, lies in the middle.

In a view comparable to FIGS. 1 and 4, the blade tip—provided with a shroud segment—of a gas turbine blade according to a preferred exemplary embodiment of the invention and the section through the shroud segment of the blade from FIG. 3 in the plane V-V, are reproduced in FIGS. 3 and 6.

Figure 13:
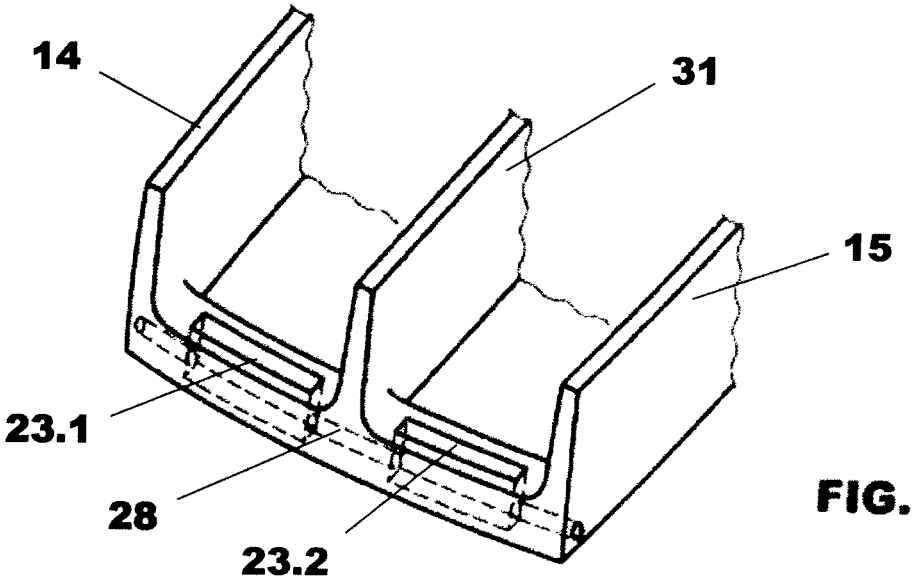
FIG. 13 shows the division of the slots when an intermediate wall segment is present.

The shroud segment 12 of the blade 10 from FIGS. 3 and 6, in contrast to the previous solution of FIGS. 1 and 4, is designed so that the side rails 16, 17 are now also convectively cooled. To this end, the cooling tubes 18 are now led directly right up to the side rails 16, 17, foregoing the gap. A rail-parallel slot 23, 24 is introduced in each case into the side rails 16, 17 and is in communication with the cooling holes 21 of the cooling tubes 18. These slots can also be arranged virtually parallel to the rails, which also applies to the slots 23.1, 23.2 from FIG. 13.

The cooling air which flows through the cooling holes 21 discharges into the slots 23, 24 and from there flows into the shroud cavity. In this way, the side rails 16, 17 are also effectively convectively cooled along the length of the slots 23, 24 without the necessity of an additional cooling air mass flow which negatively affects the efficiency of the turbine. The cooling tubes 18, in a distributed arrangement, in this case ensure that the slots 23, 24 are supplied evenly with cooling air over their entire length.

The cooling tubes 18, in the case of the embodiment which is shown in FIGS. 3 and 6, are formed on the upper side of the shroud segment 12 (when casting the blade 10) and so have a close thermal contact with the body of the shroud segment 12. The cooling holes 21 are introduced into the cooling tubes 18 from the outside, and are outwardly closed off again. The cooling holes 18 in this case can extend parallel to the wall segments 14, 15, as is shown in FIG. 3. However, the cooling holes can also be oriented obliquely to the wall segments 14, 15, according to FIG. 2. Likewise, the center piece—as shown in FIG. 6—can be arranged exactly in the middle between the wall segments 14, 15. However, the center piece can also be offset from the middle similarly to FIG. 5.

Figure 7:
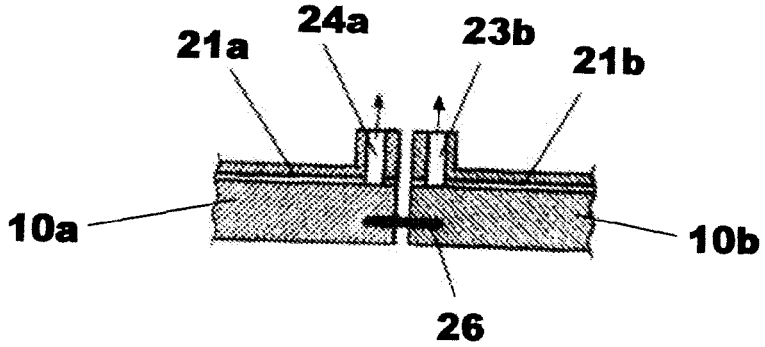
FIG. 7 shows in detail a possible connection between two adjacent shroud segments according to FIG. 6.

During the assembly of the blade ring, according to FIG. 7, a strip-like seal 26 is inserted between the abutting shroud segments of adjacent blades 10*a* and 10*b* with their cooling holes 21*a* and 21*b* and their slots 24*a* and 23*b* and prevent or hinder the penetration of hot gases from the hot gas passage into the shroud cavity.

Figure 8:
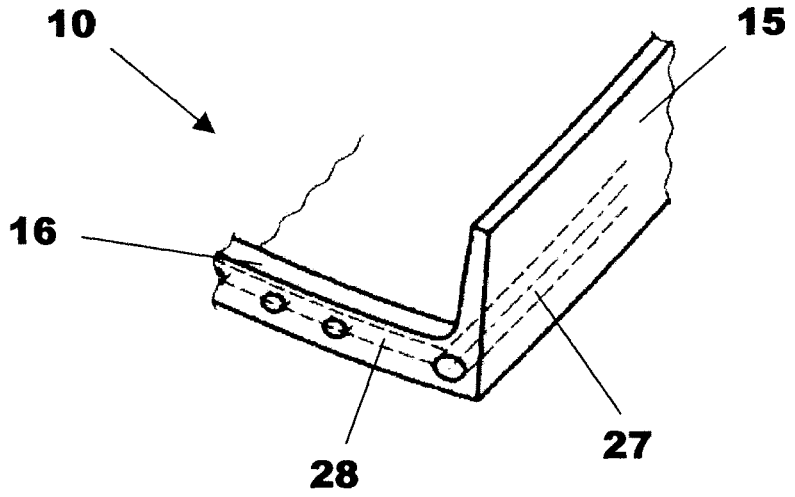
FIG. 8 shows an alternative way to FIG. 3 of supplying the slots with cooling air.
Figure 11:
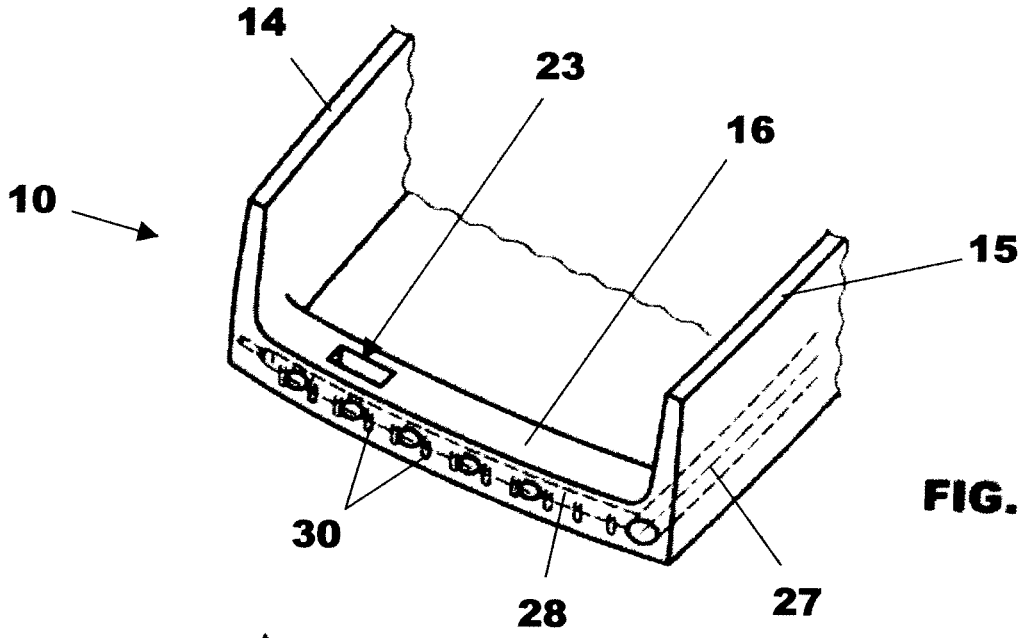
FIG. 11 shows additional film cooling holes which project from the cooling holes for the slots.
Figure 12:
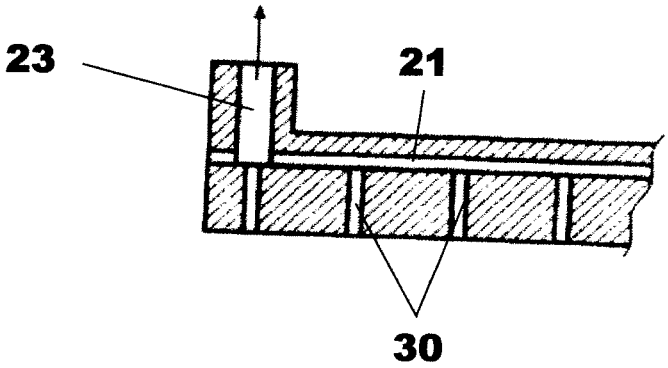
FIG. 12 shows the distribution of the film cooling holes.

Instead of, or in addition to, the cooling tube(s) 18 with the cooling holes 21, cooling holes 27, 28, through which cooling air finds its way to the slots and at the same time still brings about convective cooling of the thickened shroud regions, can be introduced in the wall segments 14, 15 or in the side rails 16, 17 (see also FIG. 8). Film cooling holes 30, which open into the hot gas passage lying beneath the shroud segment and bring about film cooling of the shroud underside there, can then project from these cooling holes, as shown in FIG. 11. This also applies to the cooling holes 21 according to FIG. 12. A cooling hole 28, which extends in the side rails 16, 17, according to FIG. 13 can also interconnect two separate slots 23.1 and 23.2 if the shroud segment is provided with an intermediate wall segment 31 which is arranged parallel between the wall segments 14, 15.

Figure 9:
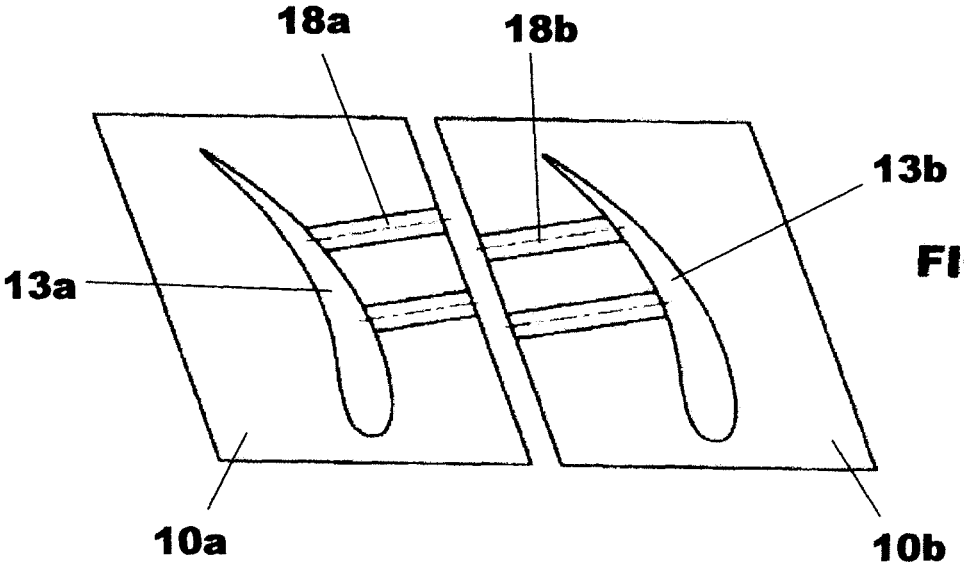
FIG. 9 shows a special arrangement of the cooling holes of adjacent shroud segments, shown in plan view.
Figure 10:
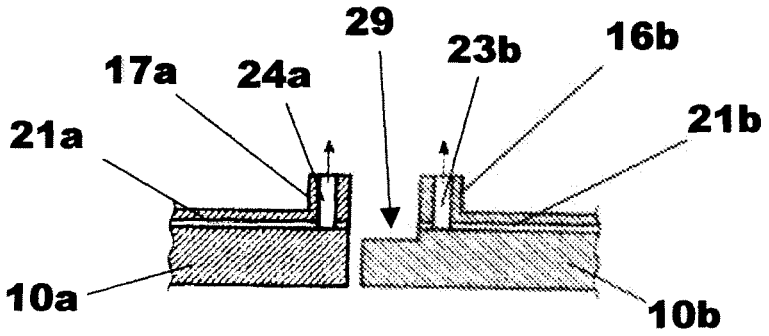
FIG. 10 shows a widened groove between adjacent shroud segments for the discharge of cooling air.

Furthermore, according to FIG. 10 provision can be made between the adjoining shroud segments of adjacent blades 10*a* and 10*b* with their side rails 17*a* and 16*b* for a widened groove-like gap 29 which is filled up with cooling air from the cooling holes 21*a*, 21*b* and so prevents penetration of hot gases. It is particularly advantageous in this case for an even filling if the cooling tubes 18*a*, 18*b*, according to FIG. 9, are then arranged in a "staggered" manner in relation to the adjacent blade.

List of Designations

10, 10' Blade (gas turbine)
10*a, b* Blade (gas turbine)
11 Blade airfoil
12, 12' Shroud segment
13 Center piece
13*a, b* Center piece
14, 15 Wall segment
16, 17 Side rail
17*a*, 16*b* Side rail
18, 18' Cooling tube
19 Tube end
20 Cooling air feed
21, 27, 28 Cooling hole
22 Gap
23, 24 Slot
23*b*, 24*a* Slot
23.1, 23.2 Slot
25 Cooling air flow
26 Seal
29 Gap
30 Film cooling hole
31 Intermediate wall segment

What is claimed is:

1. A blade, for a gas turbine, comprising a blade airfoil, having a shroud segment arranged on its upper end, the shroud segment together with shroud segments of other blades of a blade row forming an annular shroud which delimits hot gas passage of the gas turbine, and said shroud segment, on sides on which it adjoins adjacent shroud segments of the annular shroud, is provided with upwardly projecting side rails which extend along a side edge, to improve sealing to the hot gas passage, wherein the side rails comprise rail-parallel or essentially rail-parallel, upwardly open slots through which cooling air, which is introduced via the shroud segment from an interior of the blade airfoil, discharges into the space above the shroud segment.

2. The blade as claimed in claim 1, wherein an arrangement is made on an upper side of the shroud segment for a plurality of cooling tubes, extending transversely to the side rails, the cooling tubes extend from a center piece arranged between the side rails and from there are impinged upon with cooling air, and which terminate in the side rails and are in communication with the slots in said side rails.

3. The blade as claimed in claim 2, wherein the center piece is arranged in a middle between the side rails.

4. The blade as claimed in claim 3, wherein the cooling tubes extend parallel or essentially parallel to each other, and the center piece extends essentially parallel or virtually parallel to the side rails.

5. The blade as claimed in claim 4, wherein the cooling tubes extend in a circumferential direction of the shroud.

6. The blade as claimed in claim 4, wherein the cooling tubes extend obliquely to a circumferential direction of the shroud.

7. The blade as claimed in claim 2, wherein the center piece is arranged in an offset manner to a middle between the side rails.

8. The blade as claimed in claim 7, wherein the cooling tubes extend parallel or essentially parallel to each other, and the center piece extends essentially parallel or virtually parallel to the side rails.

9. The blade as claimed in claim 8, wherein the cooling tubes extend in a circumferential direction of the shroud.

10. The blade as claimed in claim 8, wherein the cooling tubes extend obliquely to a circumferential direction of the shroud.

11. The blade as claimed in claim 2, wherein the cooling tubes each have a cooling hole configured to convectively cool the shroud segment.

12. The blade as claimed in claim 2, wherein the cooling tubes are formed on the shroud segment.

13. The blade as claimed in claim 2, wherein cooling tubes of blades of adjoining shroud segments are arranged in a staggered manner.

14. The blade as claimed in claim 1, wherein the shroud segment is delimited in the axial direction by circumferentially extending wall segments, and the cooling air which discharges from the slots is fed via cooling holes in a region of the wall segments and of the side rails.

15. The blade as claimed in claim 1, wherein the shroud segment is delimited in an axial or essentially axial direction by circumferentially extending wall segments, and comprises an intermediate wall segment which is arranged in a middle between the wall segments, parallel or virtually parallel to said wall segments, and wherein the side rails, between the intermediate wall segment and the wall segments each comprise a slot.

16. The blade as claimed in claim 15, wherein the slots of a side rail are interconnected by a cooling hole which extends in the side rail.

17. The blade as claimed in claim 1, wherein film cooling holes project from the cooling holes which supply the slots and on the underside of the shroud segment open into the hot gas passage.

* * * * *